US006749078B2

(12) United States Patent
Iskra

(10) Patent No.: US 6,749,078 B2
(45) **Date of Patent: *Jun. 15, 2004**

(54) COLLECTION ASSEMBLY

(75) Inventor: Michael Iskra, Bridgewater, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 103 days.

This patent is subject to a terminal disclaimer.

(21) Appl. No.: 10/114,542

(22) Filed: Apr. 1, 2002

(65) Prior Publication Data

US 2002/0104840 A1 Aug. 8, 2002

Related U.S. Application Data

(63) Continuation-in-part of application No. 09/933,653, filed on Aug. 21, 2001, now Pat. No. 6,651,835, and a continuation-in-part of application No. 09/625,287, filed on Jul. 25, 2000, now Pat. No. 6,354,452.

(51) Int. Cl.[7] ..... B65D 25/00

(52) U.S. Cl. ..... 220/23.87; 220/592.2; 215/247; 215/12.1; 215/13.1; 422/105

(58) Field of Search ..... 215/12.1, 13.1, 215/247; 422/102, 73; 220/23.87, 62.19, 592.2

(56) References Cited

U.S. PATENT DOCUMENTS

| | | | | |
|---|---|---|---|---|
| 4,501,360 | A | | 2/1985 | Levey et al. |
| 4,830,217 | A | | 5/1989 | Dufresne et al. |
| 4,873,193 | A | | 10/1989 | Jensen et al. |
| 4,878,597 | A | | 11/1989 | Haast |
| 4,942,966 | A | | 7/1990 | Kemp |
| 5,019,243 | A | | 5/1991 | McEwen et al. |
| 5,197,602 | A | | 3/1993 | Biesecker et al. |
| 5,326,535 | A | | 7/1994 | Vogler et al. |
| 5,545,375 | A | | 8/1996 | Tropsha et al. |
| 5,711,446 | A | | 1/1998 | Jeffs et al. |
| 5,716,683 | A | * | 2/1998 | Harvey et al. ..... 428/35.9 |
| 5,833,928 | A | | 11/1998 | Ratajczak et al. |
| 5,853,600 | A | * | 12/1998 | McNeal et al. ..... 210/789 |
| 5,871,700 | A | * | 2/1999 | Konrad ..... 422/102 |
| 5,888,831 | A | * | 3/1999 | Gautsch ..... 436/177 |
| 5,906,744 | A | | 5/1999 | Carroll et al. |
| 5,968,620 | A | | 10/1999 | Harvey et al. |
| 6,066,299 | A | | 5/2000 | Lodge |
| 6,277,331 | B1 | | 8/2001 | Konrad |
| 6,651,835 | B2 | * | 11/2003 | Iskra ..... 220/23.87 |
| 2002/0011492 | A1 | | 1/2002 | Iskra |

FOREIGN PATENT DOCUMENTS

| | | |
|---|---|---|
| EP | 0 245 994 | of 1987 |
| WO | WO 01/54816 | of 2001 |

* cited by examiner

*Primary Examiner*—Joseph Man-Fu Moy
(74) *Attorney, Agent, or Firm*—Anthony J. Casella; Gerald E. Hespos

(57) ABSTRACT

The present invention is a container assembly that includes an inner tube formed from a plastic that is substantially inert to bodily fluids and an outer tube that is formed from a different plastic. Collectively, the container assembly is useful for providing an effective barrier against gas and water permeability in the assembly and for extending the shelf-life of the container assembly, especially when used for blood collection. The outer surface of the inner tube and/or the inner surface of the outer tube are provided with a matte finish that forms an array of peaks and valleys. The valleys form circuitous paths that accommodate a flow of air to facilitate insertion of the inner tube into the outer tube. The circuitous paths also allow air to vent during processing to low pressure.

15 Claims, 5 Drawing Sheets

COLLECTION ASSEMBLY

RELATED APPLICATIONS

This application is a continuation-in-part of appl. Ser. No. 09/933,653 filed on Aug. 21, 2001 now U.S. Pat. No. 6,651,835, which in turn was a continuation-in-part of appl. Ser. No. 09/625,287 filed on Jul. 25, 2000now U.S. Pat. No. 6,354,452.

BACKGROUND OF THE INVENTION

1. Field of the Invention

The invention relates to a collection container assembly that includes a plurality of nested containers formed from different respective materials and provides an effective barrier against water and gas permeability and for extending the shelf-life of assembly especially when used for blood collection.

2. Description of the Related Art

Plastic tubes contain an inherent permeability to water transport due to the physical properties of the plastic materials used in manufacturing tubes. Therefore, it is difficult to maintain the shelf-life of plastic tubes that contain a liquid additive. It is also appreciated that deterioration of the volume and concentration of the liquid additive may interfere with the intended use of the tube.

In addition, plastic tubes that are used for blood collection require certain performance standards to be acceptable for use in medical applications. Such performance standards include the ability to maintain greater than about 90% original draw volume over a one-year period, to be radiation sterilizable and to be non-interfering in tests and analysis.

Therefore, a need exists to improve the barrier properties of articles made of polymers and in particular plastic blood collection tubes wherein certain performance standards would be met and the article would be effective and usable in medical applications. In addition, a need exists to preserve the shelf-life of containers that contain liquid additives. The time period for maintaining the shelf-life is from manufacturing, through transport and until the container is actually used.

Some prior art containers are formed as an assembly of two or more nested containers. The nested containers are formed from different respective materials, each of which is selected in view of its own unique characteristics. Some nestable containers are dimensioned to fit closely with one another. Containers intended for such assemblies necessarily require close dimensional tolerances. Furthermore, air trapped between the two closely fitting nestable containers can complicate or prevent complete nesting. Some prior art container assemblies have longitudinal grooves along the length of the outer surface of the inner container and/or along the length of inner surface of the outer container. The grooves permit air to escape during assembly of the containers. However, the grooves complicate the respective structures and the grooved containers still require close dimensional tolerances.

Other container assemblies are dimensioned to provide a substantially uniform space at all locations between nested inner and outer containers. Air can escape from the space between the dimensionally different containers as the containers are being nested. Thus, assembly of the nestable containers is greatly facilitated. Additionally, the nestable containers do not require close dimensional tolerances. However, the space between the inner and outer containers retains a small amount of air and the air may be compressed slightly during final stages of nesting. Some such container assemblies are intended to be evacuated specimen collection containers. These container assemblies are required to maintain a vacuum after extended periods in storage. However, air in the space between the inner and outer containers is at a higher pressure than the substantial vacuum in the evacuated container assembly. This pressure differential will cause the air in the space between the inner and outer containers to migrate through the plastic wall of the inner container and into the initially evacuated space of the inner container. Hence, the effectiveness of the vacuum in the container assembly will be decreased significantly. These problems can be overcome by creating a pressure differential between the annular space and the inside of the inner container to cause a migration of air through the walls of the inner container. The inner container then is evacuated and sealed. This approach, however, complicates and lengthens an otherwise efficient manufacturing cycle.

SUMMARY OF THE INVENTION

The present invention is a container assembly comprising inner and outer containers that are nested with one another. The inner and outer containers both are formed from plastic materials, but preferably are formed from different plastic materials. Neither plastic material is required to meet all of the sealing requirements for the container. However, the respective plastic materials cooperate to ensure that the assembly achieves the necessary sealing, adequate shelf life and acceptable clinical performance. One of the nested containers may be formed from a material that exhibits acceptable gas barrier characteristics, and the other of the containers may be formed from a material that provides a moisture barrier. The inner container also must be formed from a material that has a proper surface for the specified clinical performance of the material being stored in the container assembly. Materials that exhibit good gas barrier characteristics may include: acrylic polymers and copolymers, including ABS, SAN; ethylene vinyl alcohol; polyesters; PET; PETG; PETN; PEN and engineered thermoplastics, including polycarbonate and blends thereof. Materials that exhibit good moisture or vapor barrier characteristics may include: polyolefins, including polyethylene, polypropylene and copolymers thereof, cyclic olefin copolymers and chloro-and fluoro-polymers, including PVDC, PVDF, PVF, EPF and ACLAR. Preferably, the inner container is formed from polypropylene (PP), and the outer container is formed from polyethylene terephthalate (PET).

The inner and outer containers of the container assembly preferably are tubes, each of which has a closed bottom wall and an open top. The outer tube has a substantially cylindrical side wall with a selected inside diameter and a substantially spherically generated bottom wall. The inner tube has an axial length that is less than the outer tube. As a result, a closure can be inserted into the tops of the container assembly for secure sealing engagement with portions of both the inner and outer tubes. The outer surface of the inner tube and the inner surface of the outer tube are dimensioned to substantially nest with one another as explained further herein.

The cylindrically generated outer surface of the inner tube and/or the cylindrically generated inner surface of the outer tube have a matte finish or are roughened to define an array of small peaks and valleys. The maximum diameter defined by the peaks on the outer surface of the inner tube may be equal to or slightly greater than the inside diameter of the outer tube. Similarly, the minimum diameter defined by peaks on the inner surface of the outer tube may be equal to or slightly less than the outside diameter of the inner tube. Hence, the peaks defined by the matte-finish or by the roughening will provide secure engagement between the inner and outer tubes. However, the valleys between the peaks defined by the matte-finished or roughening will define circuitous paths for venting air trapped between the inner and outer tubes as the tubes are being assembled and after the tubes have been assembled. Liquid is prevented from entering the space between the inner and outer tubes because due to the pore size created by the matte finish and due to the viscosity and surface tension of the liquid. As a result, the container assembly achieves efficient nesting without longitudinal grooves and close dimensional tolerances and simultaneously enables evacuation of air from the space between the inner and outer tubes so that a vacuum condition can be maintained within the inner tube for an acceptably long time and prevents liquid from entering the space between the inner and outer tubes.

DETAILED DESCRIPTION

Figure 1:
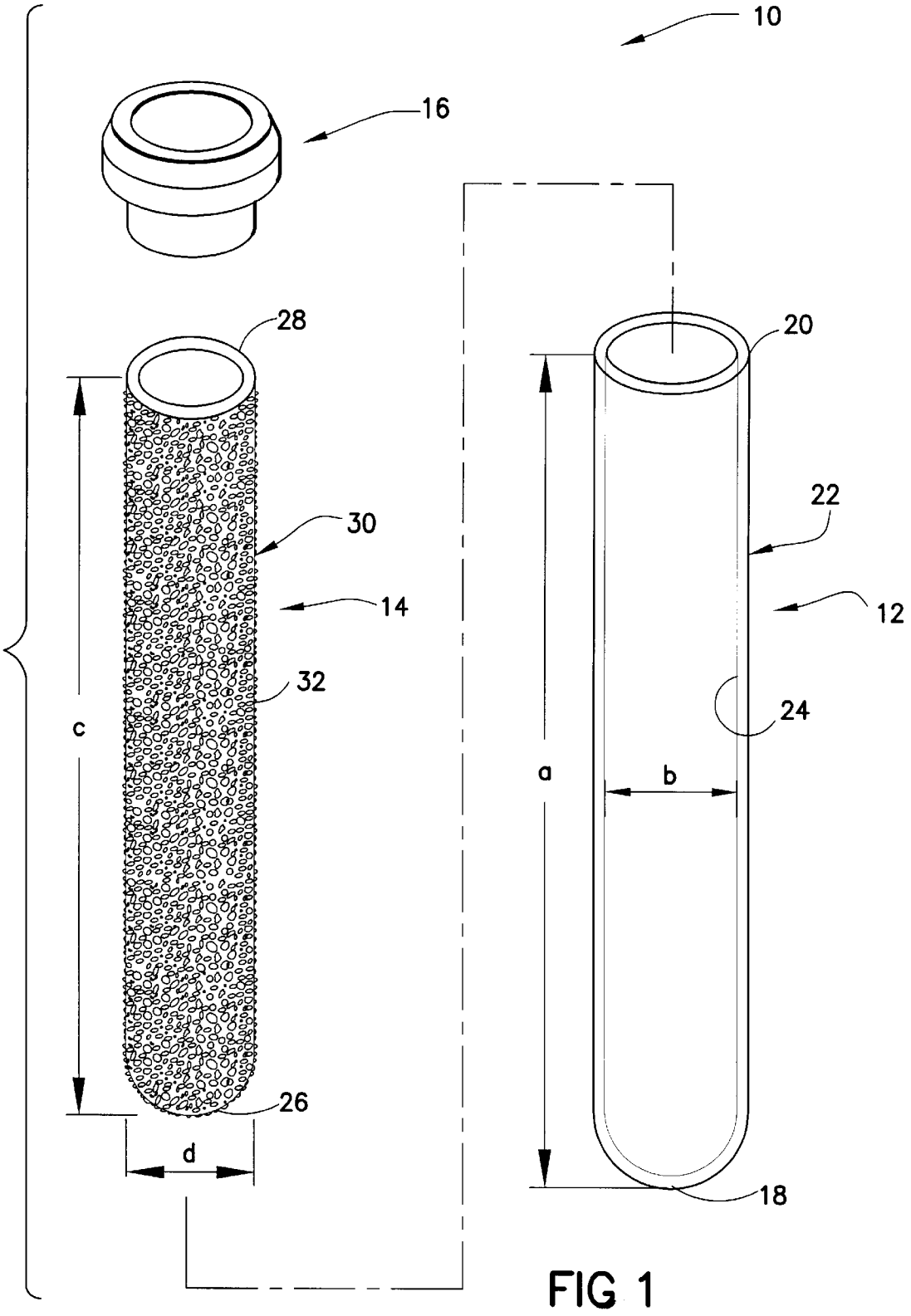
FIG. 1 is an exploded perspective view of the container assembly of the present invention.

As shown in FIGS. 1–6, an assembly 10 includes an outer tube 12, an inner and a closure 16.

Outer tube 12 is unitarily formed from PET and includes a spherically generated closed bottom wall 18, an open top 20 and a cylindrical wall 22 substantially extending there between. However, side wall 22 slightly tapers from open top 20 to closed bottom wall 18. Outer tube 12 defines a length "a" from the interior of the bottom wall 18 to the open top 20. Side wall 22 of outer tube 12 includes a cylindrically generated inner surface 24 with an inside diameter "b".

Inner tube 14 is formed unitarily from polypropylene and includes a spherically generated closed bottom wall 26, an open top 28 and a substantially cylindrical side wall 30 extending therebetween. However, side wall 30 slightly tapers from open top 28 to closed bottom wall 26. Inner tube 14 defines an external length "c" that is less than internal length "a" of outer tube 12.

Cylindrical side wall 30 of inner tube 14 has an outer surface 32 with an outside diameter "d" hat is substantially equal to or slightly less than inside diameter "b" of side wall 22 on outer tube 12. Cylindrical outer surface 32 of side wall 30 is provided with a matte finish or is roughened to define an array of peaks and valleys. Preferably, the roughened side wall is formed by injection molding within tooling that has been machined by an electrical discharge machining (EDM) process so as to form an electrical discharge machining finish. The finished part then is compared visually with a visual standard, such as the Charmilles Technologies Company visual surface standard (Charmilles Technology Company, Lincolnshire, Ill.). Using this standard practice, the matte-finished or roughened cylindrical outer surface 32 of side wall 30 defines a surface finish of 1.6 to 12.5 microns and more preferably a surface finish of 4.5 to 12.5 microns. Additionally, the roughened cylindrical outer surface 32 should be cross-referenced visually to a Charmilles finish number between 24 and 42 and more preferably between 30 and 42.

Figure 6:
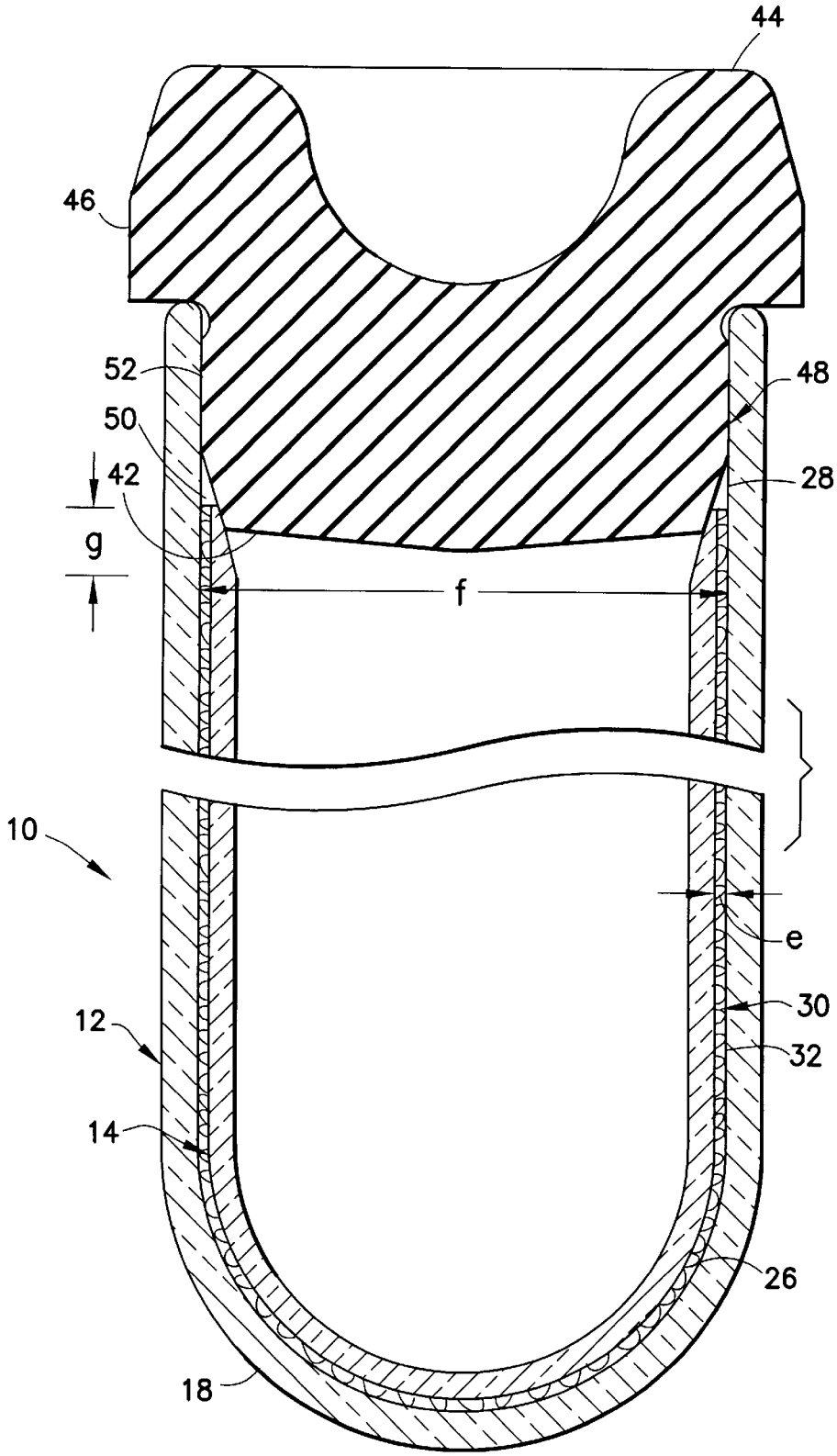
FIG. 6 is a cross-sectional view taken along line 6—6 of FIG. 5.

The peaks on roughened cylindrical outer surface 32 of side wall 30 define an outside diameter "f" which is approximately equal to or slightly greater than inside diameter "b" of side wall 22 of outer tube 12. Hence, roughened cylindrical outer surface 32 of cylindrical side wall 30 will telescope tightly against cylindrical inner surface 24 of side wall 22 of outer tube 12 as shown in FIGS. 3 and 6.

Figure 4:
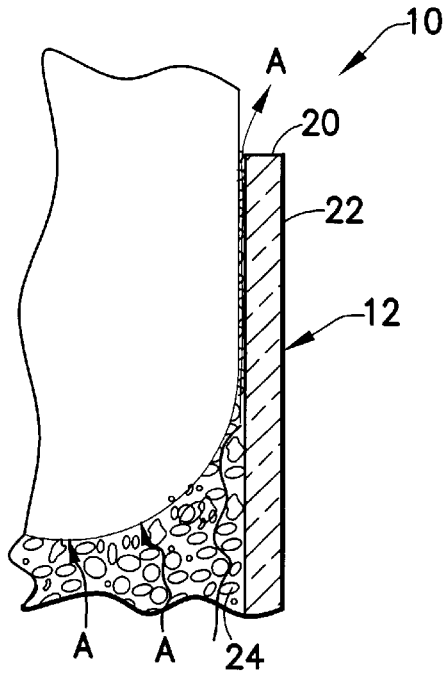
FIG. 4 is a cross-sectional view similar to FIG. 3, but showing an alternate embodiment.
Figure 5:
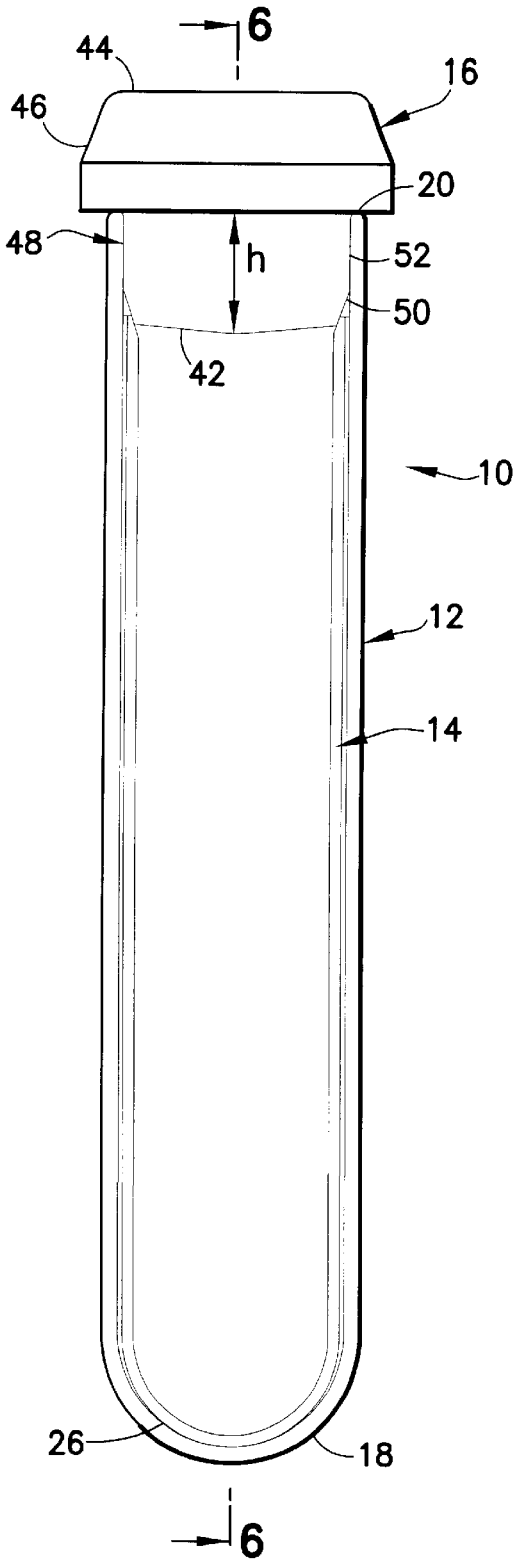
FIG. 5 is a side elevational view of the container assembly of FIG. 1 in its assembled condition.

As an alternate to the roughening of the outer surface on inner tube 14, cylindrical wall 22 of outer tube 12 may have a matte finish or roughening on inner surface 24 of cylindrical wall 12 as shown in FIG. 4. The extent of roughening inner surface 24 may be identical to the roughening on the outer surface described with respect to a first embodiment.

Closure 16 preferably is formed from rubber and includes a bottom end 42 and a top end 44. Closure 16 includes an external section 46 extending downwardly from top end 44. External section 46 is cross-sectionally larger than outer tube 12, and hence will sealingly engage against open top end 20 of outer tube 12. Closure 16 further includes an internal section 48 extending upwardly from bottom end 42. Internal section 48 includes a conically tapered lower portion 50 and a cylindrical section 52 adjacent tapered section 50. Internal section 48 defines an axial length "h" that exceeds the difference between internal length "a" of outer tube 12 and external length "c" of inner tube 14. Hence, internal section 48 of closure 16 will engage portions of outer tube 12 and inner tube 14 adjacent the respective open tops 20 and 28 thereof, as explained further below. Internal section 52 of closure 16 is dimensioned cross-sectionally to ensure secure sealing adjacent open tops 22 and 28 respectively of outer tube 12 and inner tube 14.

Figure 2:
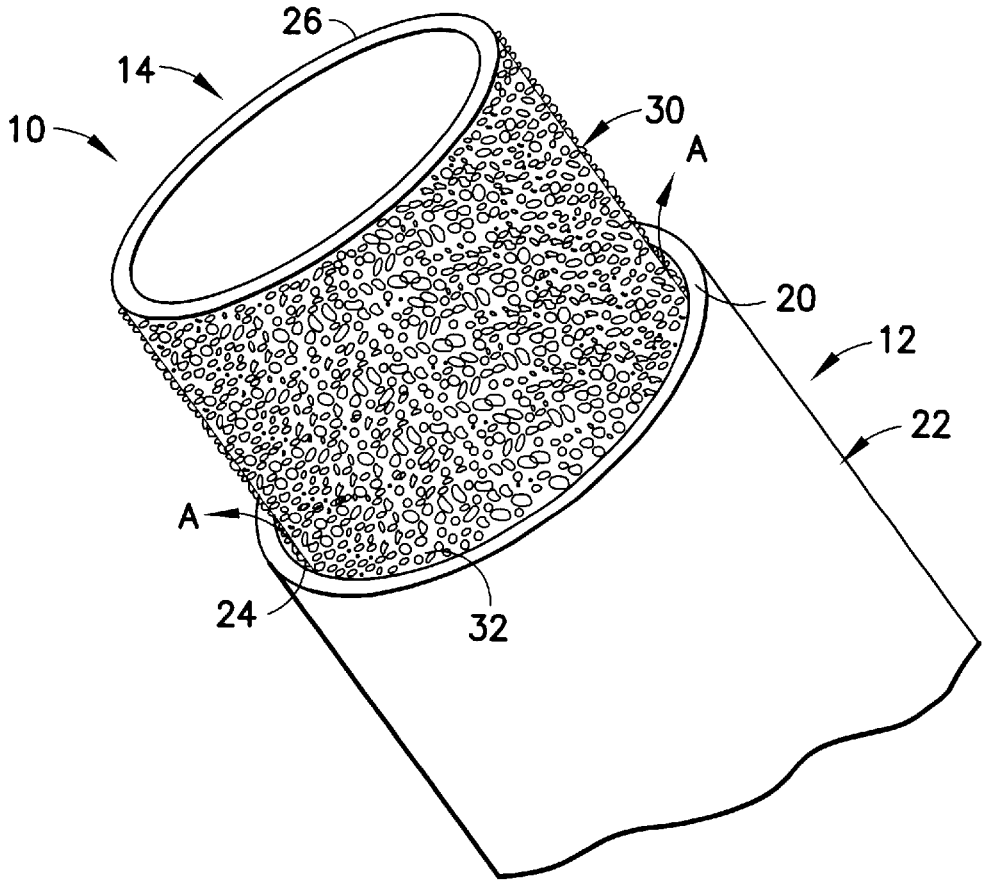
FIG. 2 is a perspective view of the inner and outer containers at a first stage during their assembly.
Figure 3:
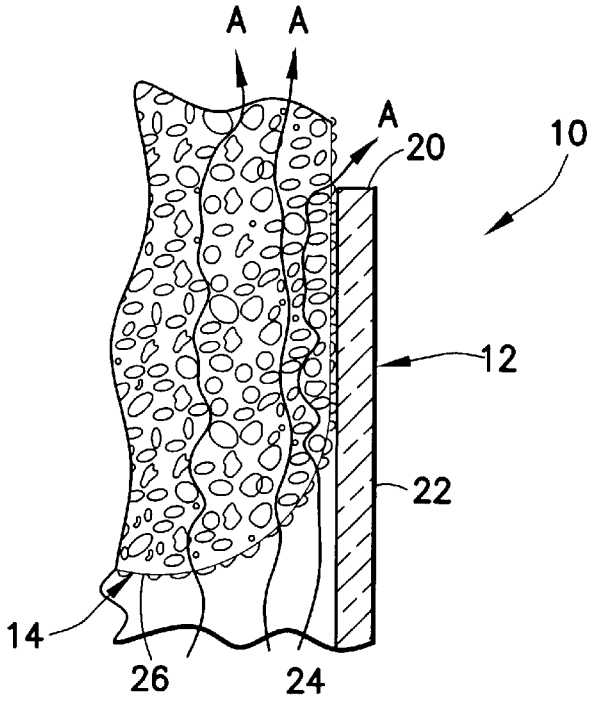
FIG. 3 is a cross-sectional view taken along line 3—3 in FIG. 2.

Assembly 10 is assembled by slidably inserting inner tube 14 into open top 20 of outer tube 12, as shown in FIGS. 2–4. Air in outer tube 12 will escape through the valleys between the peaks defined by the matte finish or roughening provided on outer surface 32 of inner tube 14, as shown by the arrow "A" in FIG. 3 or through the valleys between the peaks of the matte finish or roughening on inner surface 24 of outer tube 12, as shown by the arrow "A" in the FIG. 4 embodiment. This relatively easy insertion of inner tube 14 into outer tube 12 is achieved without an axial groove in either of the tubes. However the roughening provided on cylindrical outer surface 32 of side wall 30 of inner tube 14 defines an array of peaks and valleys. The peaks define the outside diameter "f" and hence define portions of cylindrical outer surface 32 that will engage cylindrical inner surface 24 of side wall 22 of outer tube 12. Roughening to a Charmilles finish number between 30 and 42 provides a sufficient density of peaks to grip the opposed cylindrical inner surface 24. The valleys between the peaks of roughened cylindrical outer surface 32 are spaced from cylindrical inner surface 24 of side wall 22 of outer tube 12. Similarly, the roughened cylindrical inner surface 24 of outer tube 12 on the alternate embodiment of FIG. 4 would be spaced from outer cylindrical surface 32 of side wall 30 on inner tube 14 as shown on FIG. 4. Hence, the valleys between the peaks on roughened cylindrical outer surface 32 or roughened cylindrical inner surface 24 define circuitous passages that permit an escape of air between inner tube 14 and outer tube 12, as indicated by arrow "A" in FIGS. 3 and 4. Insertion of inner tube 14 into outer tube 12 continues with little air resistance until the outer surface of spherically generated bottom wall 26 of inner tube 12 abuts the inner surface of bottom wall 18 on outer tube 12 in an internally nested relationship. In this condition, as shown most clearly in FIGS. 5 and 6, inner tube 14 is supported by the internally nested relationship of bottom wall 26 of inner tube 14 with bottom wall 18 of outer tube 12. Additionally, inner tube 14 is supported further by the circumferential engagement of the peaks on outer circumferential surface 32 with inner circumferential surface 24 of side wall 22 on outer tube 12 or with the reverse engagement of peaks on inner circumferential surface 24 of outer tube 12 with outer circumferential surface 32 of inner tube 14. Hence, inner tube 14 is maintained stably within outer tube 12 with little or no internal movement that could be perceived as a sloppy fit. This secure mounting of inner tube 14 within outer tube 12 is achieved without a requirement for close dimensional tolerances along most of the length of the respective inner and outer tubes 14 and 12 respectively due to the ability of the peaks to yield and deform slightly.

Air will exist in the space defined by the valleys between the peaks. However, the volume of air will not be great, and the air will not be in a compressed high pressure state. Accordingly, there will not be a great pressure differential between valleys defined by the matte finish or roughening and the outer surface 32 of inner tube 14, and migration of air through the plastic material of side wall 30 of inner tube 14 will not be great. Migration of air through side wall 30 of inner tube 14 can be reduced further by evacuating the space defined by the valleys between the peaks generated by the matte finish or roughening. More particularly, the assembly of outer and inner tubes 12 and 14 can be placed in a low pressure environment. The pressure differential will cause air in valleys defined by the matte finish or roughening to traverse the circuitous path of valleys between the peaks to the lower pressure ambient surroundings.

The assembly of inner tube 14 with outer tube 12 can be sealed by stopper 16. In particular, tapered portion 50 of internal section 48 facilitates initial insertion of stopper 16 into open top 20 of outer tube 12. Sufficient axial advancement of stopper 16 into open top 20 will cause cylindrical outer surface 52 of internal section 48 to sealingly engage internal surface 24 of outer tube 12. Further insertion will cause tapered surface 50 of internal section 48 to sealingly engage the internal surface of inner tube 14 adjacent open top 28. Hence, closure 16 securely seals the interior of inner tube 14 and the valleys between the peaks formed by the matte finish or roughening between inner tube 14 and outer tube 12.

While the invention has been defined with respect to a preferred embodiment, it is apparent that changes can be made without departing from the scope of the invention as defined by the appended claims.

What is claimed is:

1. A container assembly comprising an outer container formed from a first plastic material and having a closed bottom wall, an open top and a side wall extending from said closed bottom wall of said outer container to said open top of said outer container, said side wall of said outer container having an inner surface, said container assembly further comprising an inner container formed from a second plastic material and having a closed bottom wall, an open top and a side wall extending from said closed bottom wall of said inner container to said open top of said inner container, said side wall of said inner container having an outer surface, at least one of said inner surface of said side wall of said outer container and said outer surface of said side wall of said inner container being formed with a matte finish defining an array of peaks and valleys, said peaks being dimensioned to achieve secure nesting of said inner container within said outer container, said valleys defining a plurality of circuitous passages between said peaks for accommodating airflow between said peaks, said circuitous passages facilitating insertion of said inner container into said outer container and accommodating an escape of air during exposure to a low pressure environment.

2. The container assembly of claim 1, wherein said matte finish is an electrical discharge machining finish with a roughening in a range of 1.6 to 12.5 microns.

3. The container assembly of claim 1, wherein said matte finish conforms to a Charmilles finish number in a range of about 24 to about 42.

4. The container assembly of claim 1, wherein a first of said containers is formed from a plastic material that exhibits desirable characteristics as a gas barrier, and wherein a second of the containers is formed from a plastic material that exhibits desirable characteristics as a moisture barrier.

5. The container assembly of claim 1, wherein said inner container is formed from polypropylene.

6. The container assembly of claim 5, wherein said outer container is formed from PET.

7. The container assembly of claim 1, wherein the matte finish is formed on said outer surface of said side wall of said inner container.

8. The container assembly of claim 1, wherein the matte finish if formed on said inner surface of said side wall of said outer container.

9. The container assembly of claim 1, further comprising a closure sealingly engaged with portions of said inner and outer containers adjacent said open tops thereof.

10. The container assembly of claim 1, wherein said first and second containers are substantially cylindrical tubes.

11. A container assembly comprising:

an outer tube unitarily formed from PET, the outer tube having a substantially spherically generated closed bottom wall, an open top and a cylindrical side wall extending therebetween, said side wall having an inner surface; and an inner tube unitarily formed from polypropylene and having a substantially spherically generated closed bottom wall, an open top and a side wall extending from said closed bottom wall to said open top, said side wall of said inner tube having an outer surface formed with a matte finish defining an array of peaks and valleys, said inner tube being disposed within said outer tube such that said bottom wall of said inner tube abuts said bottom wall of said outer tube, said peaks of said matte finish on said outer surface of said side wall of said inner tube abutting said inner surface of said side wall of said outer tube, said valleys between said peaks of said matte finish defining an array of circuitous paths between said inner and outer tubes for accommodating a flow of air between said inner and outer tubes and facilitating insertion of said inner tube into said outer tube.

12. The container assembly of claim 11, wherein said roughened outer surface adjacent said open top of said inner container defines a roughening as formed with an electrical discharge machine finish in a range of 4.5 to 12.5 microns.

13. The container assembly of claim 12, wherein said roughened outer surface adjacent said open top of said inner container conforms to a Charmilles finish number in a range of about 30 to about 42.

14. The container assembly of claim 11, further comprising a closure for closing the respective open top ends of the inner and outer tubes.

15. The container assembly of claim 14, wherein the closure is formed from rubber.

* * * * *